US006890136B2

(12) United States Patent
Heim et al.

(10) Patent No.: US 6,890,136 B2
(45) Date of Patent: May 10, 2005

(54) VEHICLE TRANSPORTATION MODULE

(75) Inventors: Ralph W. Heim, Jacksonville, FL (US); J. Edward Morley, Jacksonville, FL (US); Prakas W. Shahani, Clinton, NJ (US)

(73) Assignee: Trailer Bridge, Inc., Jacksonville, FL (US)

( * ) Notice: Subject to any disclaimer, the term of this patent is extended or adjusted under 35 U.S.C. 154(b) by 221 days.

(21) Appl. No.: 10/286,325

(22) Filed: Nov. 1, 2002

(65) Prior Publication Data

US 2003/0095844 A1 May 22, 2003

Related U.S. Application Data

(62) Division of application No. 09/793,022, filed on Feb. 26, 2001, now Pat. No. 6,503,034, which is a division of application No. 09/364,910, filed on Jul. 28, 1999, now Pat. No. 6,416,264.

(60) Provisional application No. 60/094,601, filed on Jul. 30, 1998.

(51) Int. Cl.[7] ..... B60P 7/08

(52) U.S. Cl. ..... 410/4; 410/24; 410/26

(58) Field of Search ..... 410/4, 24, 25, 410/26, 30; 220/1.5; 105/355; 414/498

(56) References Cited

U.S. PATENT DOCUMENTS

| | | | | |
|---|---|---|---|---|
| 1,247,553 | A | 11/1917 | Linquist et al. | |
| 1,290,818 | A | 1/1919 | Duncan | |
| 2,022,376 | A | 2/1935 | Judd | |
| 2,492,980 | A | 4/1950 | Garnett | |
| 2,521,088 | A | 9/1950 | Phelps | |
| 2,587,456 | A | 2/1952 | Francis | |
| 3,110,361 | A | 11/1963 | Hirsch | |
| 3,180,283 | A | 4/1965 | Sharp | |
| 3,646,609 | A | 2/1972 | Bodenheimer | |
| 3,709,155 | A | 1/1973 | Pringle | |
| 3,934,740 | A | 1/1976 | Rumell | |
| 4,343,401 | A | 8/1982 | Paulyson | |
| 4,759,668 | A | 7/1988 | Larsen et al. | 410/26 |
| 4,801,229 | A | 1/1989 | Hanada et al. | 410/26 |
| 4,875,821 | A | 10/1989 | Oren | |
| 4,911,590 | A | 3/1990 | Green | 410/26 |
| 4,963,067 | A | 10/1990 | Gearin et al. | |
| 5,032,044 | A | 7/1991 | Dorst | 410/26 |
| 5,037,255 | A | 8/1991 | Bullock et al. | 410/30 |
| 5,044,866 | A | 9/1991 | Harp | |
| 5,051,046 | A | 9/1991 | Oren | 410/29.1 |
| 5,106,246 | A | 4/1992 | Chance | 410/26 |
| 5,110,242 | A | 5/1992 | Chance | 410/26 |
| 5,114,202 | A | 5/1992 | Johnson | |
| 5,213,458 | A | 5/1993 | Preller et al. | 410/26 |
| 5,286,149 | A | 2/1994 | Seay et al. | 410/26 |
| 5,344,266 | A | 9/1994 | Kolb | 410/26 |
| 5,413,224 | A | 5/1995 | Marron et al. | |
| 5,427,485 | A | 6/1995 | Henderson et al. | 410/26 |
| 5,525,026 | A | 6/1996 | DeMonte et al. | |
| 5,526,940 | A | 6/1996 | Shea et al. | |
| 5,584,527 | A | 12/1996 | Sitter | |
| 5,669,745 | A | 9/1997 | Anderson | 410/87 |
| 5,730,578 | A | 3/1998 | Smidler | |
| 5,743,689 | A | 4/1998 | Schlaeger | 410/30 |
| 5,775,858 | A | 7/1998 | Bacon | 410/26 |

(Continued)

FOREIGN PATENT DOCUMENTS

| | | |
|---|---|---|
| CA | 527696 | 7/1956 |

*Primary Examiner*—Stephen Gordon
(74) *Attorney, Agent, or Firm*—Thompson Hine LLP

(57) ABSTRACT

A module for receiving motorized vehicles for transportation. The module includes a driver-side side wall, a passenger-side side wall parallel to and laterally spaced from the driver-side side wall, and a bottom support structure extending between the side walls for supporting at least one vehicle located thereon. The module further includes a roof spaced from the bottom support structure such that the roof and the bottom support structure are arranged to closely receive a single layer of vehicles therebetween.

21 Claims, 4 Drawing Sheets

U.S. PATENT DOCUMENTS 5,797,712 A 8/1998 Gearin et al. ..... 410/16
5,816,423 A 10/1998 Fenton et al.
5,853,280 A 12/1998 Lohr
6,010,285 A 1/2000 Cox et al.
6,416,264 B2 7/2002 Heim et al. ..... 410/4
6,503,034 B2 1/2003 Heim et al. ..... 410/4

VEHICLE TRANSPORTATION MODULE

This application claims priority to U.S. Ser. No. 60/094,601 filed Jul. 30, 1998. This application is a divisional application of Ser. No. 09/793,022, filed Feb. 26, 2001 (now U.S. Pat. No. 6,503,034), which is in turn a divisional application of Ser. No. 09/364,910, filed Jul. 28, 1999 (now U.S. Pat. No. 6,416,264).

BACKGROUND OF THE INVENTION

The present invention is directed to vehicle transportation systems, and more particularly, to modules for receiving vehicles for transportation by common carrier.

Standard-sized freight containers are often used when transporting motorized vehicles, such as cars, trucks, sport utility vehicles and the like. Once the vehicles are mounted in the freight containers, the containers can be loaded on trains, barges, truck chasses and other transportation systems. When vehicles are transported inside a container, it is, of course, desired to minimize damage imparted to the vehicles by the container. The standard-sized freight containers used to transport vehicles are relatively narrow, typically having a width of about 8 feet. Thus, when a vehicle is placed into such a container, typically by driving them into the container, it may be difficult for a driver to open the vehicle door and exit the vehicle and container without damaging the vehicle. The lack of clearance between vehicle and container increases the chances of damaging vehicles during vehicle loading and unloading operations. It is also difficult for a worker to access a vehicle stored in such a container in order to secure the vehicle in the container, or to walk by the vehicle without contacting the vehicle.

Space is at a premium in transportation systems, and since standard freight containers are not optimally sized to receive vehicles such containers include much wasted space when transporting vehicles. For example, standard freight containers have a height of either 8' 6", or 9' 6", and vehicles typically have a height of between about 4' 11" and about 6' 6", which means that there is usually a large amount of unutilized space located over the roofs of the vehicles after they are loaded into a standard container. The containers are often stacked on top of each other, which compounds the wasted vertical space.

To address this problem, systems have been developed which stack or otherwise arrange two layers of vehicles within a single freight container. These containers can be either generally open containers that lack side walls or closed containers having side walls. However, stacking two layers of vehicles requires additional machinery, power and time, all of which contribute to increased shipping costs. The vehicles can also be easily damaged during the stacking and/or arranging operations, and the open containers often do not provide adequate protection from the elements. Furthermore, it can be difficult to load and unload vehicles into standard freight containers. Typically, a ramp must be attached to the container to guide the driven vehicles into the container, or machinery must be used to load the vehicles, which further complicates the loading process. When a ramp is used, it extends rearwardly of the container, and thereby requires additional space on the loading surface.

Accordingly, there is a need for a vehicle transportation module that is specifically sized and designed to receive vehicles such that wasted space within the module is minimized. There is also a need for a vehicle transportation module which can be quickly and easily loaded and unloaded, while minimizing damage to the vehicles.

SUMMARY OF THE INVENTION

The present invention is a vehicle transportation module that is specifically designed and sized to receive vehicles for quick and efficient loading. For example, the module has a height that corresponds to the height of the received vehicles to minimize wasted space in the vertical direction. Furthermore, when the module of the present invention is loaded onto a chassis, the module can pass under bridges and underpasses. The module also preferably has a width that is sized to relatively closely receive the vehicles to minimize wasted space in the horizontal direction, while still providing sufficient clearance to enable the driver to safely exit the vehicle and the module. Finally, the module preferably has a length that is selected such that a predetermined number of vehicles may be closely received therein, thereby minimizing wasted space in the longitudinal direction.

The module of the present invention also includes a plurality of openings that are located to correspond to the front driver-side door of each of the loaded vehicles. In this manner, the driver can open the front driver-side door into one of the openings, and can thereby exit the vehicle and the module without damaging the vehicle door or any other vehicles. The module also includes bottom openings that enable the placement of securements, such as wheel chocks and the like, within the module without having to enter the module. Finally, the module of the present invention includes an integral, internal ramp such that the vehicles may be driven directly into the module to enable quick and efficient loading.

In a preferred embodiment, the invention is a module for receiving motorized vehicles for transportation. The module includes a driver-side side wall, a passenger-side side wall parallel to and laterally spaced from the driver-side side wall, and a bottom support structure extending between the side walls for supporting at least one vehicle located thereon. The module further includes a roof spaced from the bottom support structure such that the roof and the bottom support structure are arranged to closely receive a single layer of vehicles therebetween.

Accordingly, it is an object of the present invention to provide a vehicle transportation module which can be used in a variety of transportation modes, including chassis, vessel, and rail; which minimizes wasted space; which is quickly and easily loaded; which protects vehicles from external elements; and which minimizes damage to vehicles during loading.

Other objects and advantages of the present invention will be apparent from the following description, the accompanying drawings and the appended claims.

DETAILED DESCRIPTION

Figure 1:
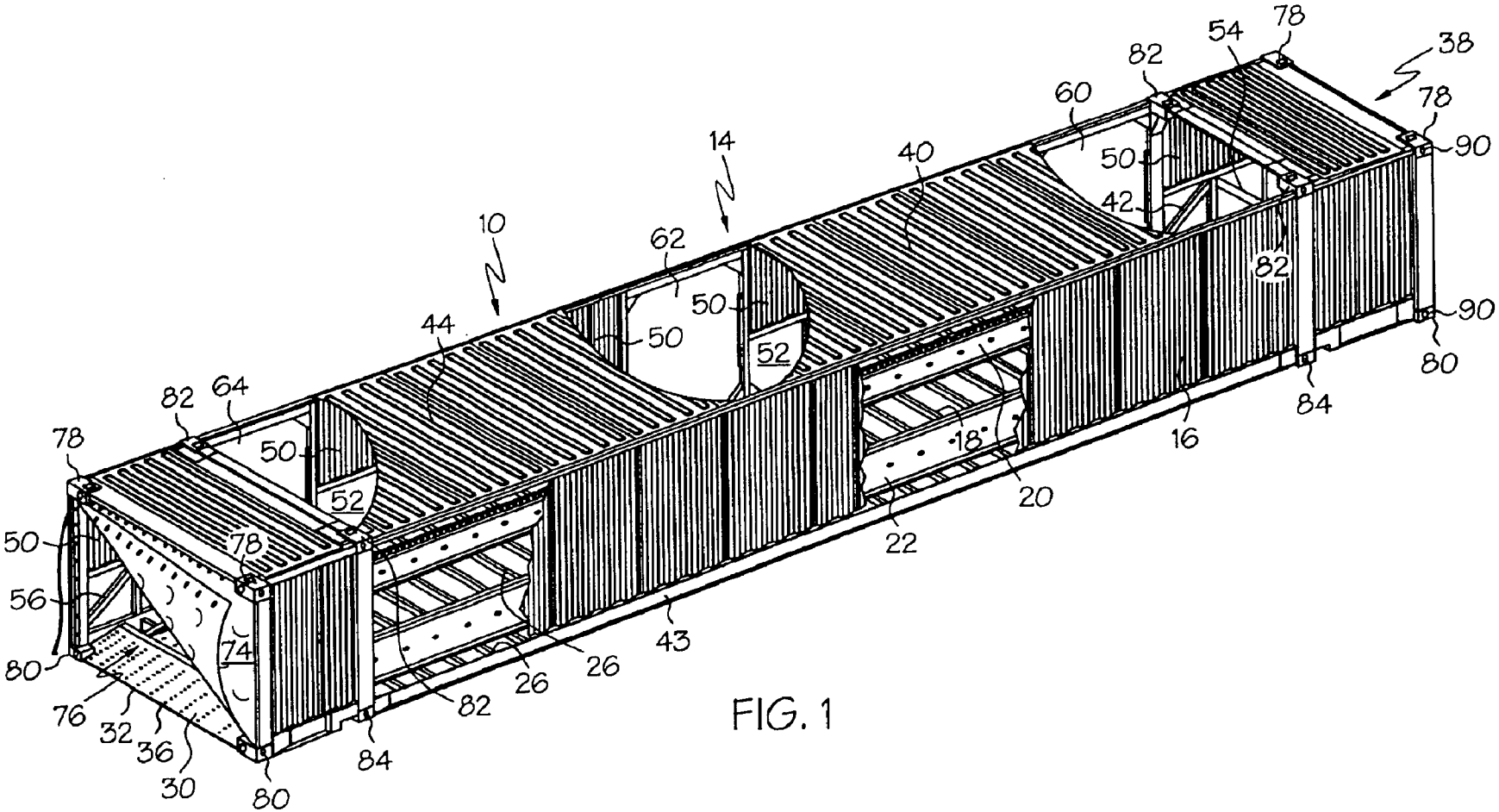
FIG. 1 is a top perspective view of a preferred embodiment of the module of the present invention, with parts of the passenger-side side wall and roof cut away.

As shown in FIG. 1, the present invention is a module 10 for receiving and transporting motorized vehicles 12 (FIG.

3). The module 10 is generally rectangular in cross-section, and includes a driver-side side wall 14 and a passenger-side side wall 16 that extends parallel to, and is laterally spaced apart from, the driver-side side wall 14. For the purposes of this application, the steering wheel and the driver of the vehicles 12 have been assumed to be on the left hand side of each vehicle 12. However, the module 10 of the present invention can be easily modified to accommodate vehicles where the steering wheel is located on the right hand side of the vehicle by changing the orientation of several components of the module 10 in a manner that would be readily apparent to one skilled in the art.

Figure 4:
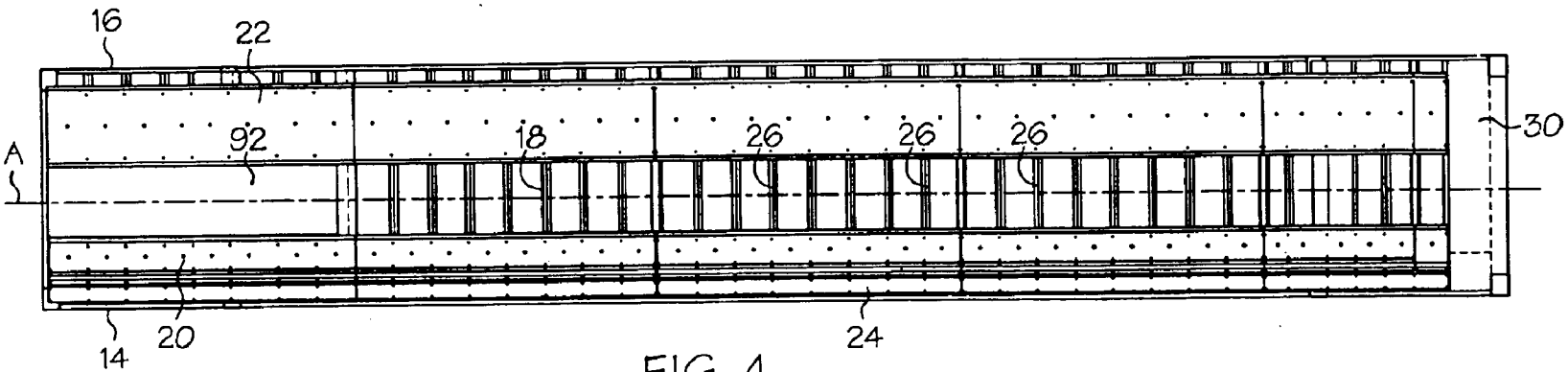
FIG. 4 is a section taken at line 4—4 of FIG. 3.
Figure 5:
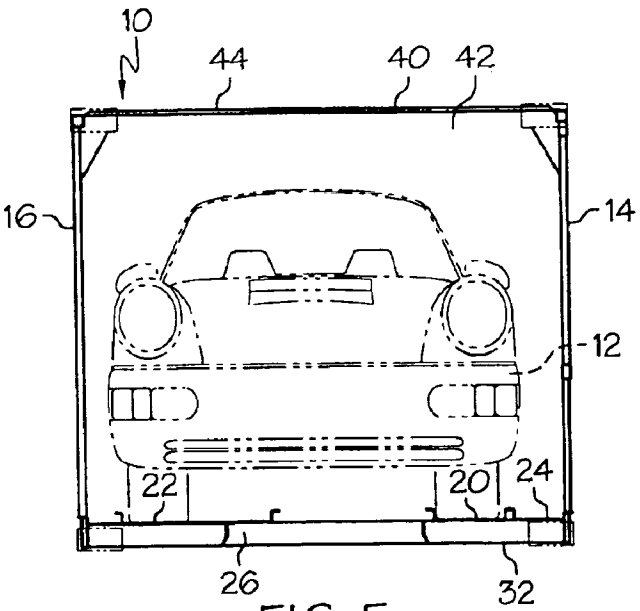
FIG. 5 is a section taken at line 5—5 of FIG. 3.
Figure 6:
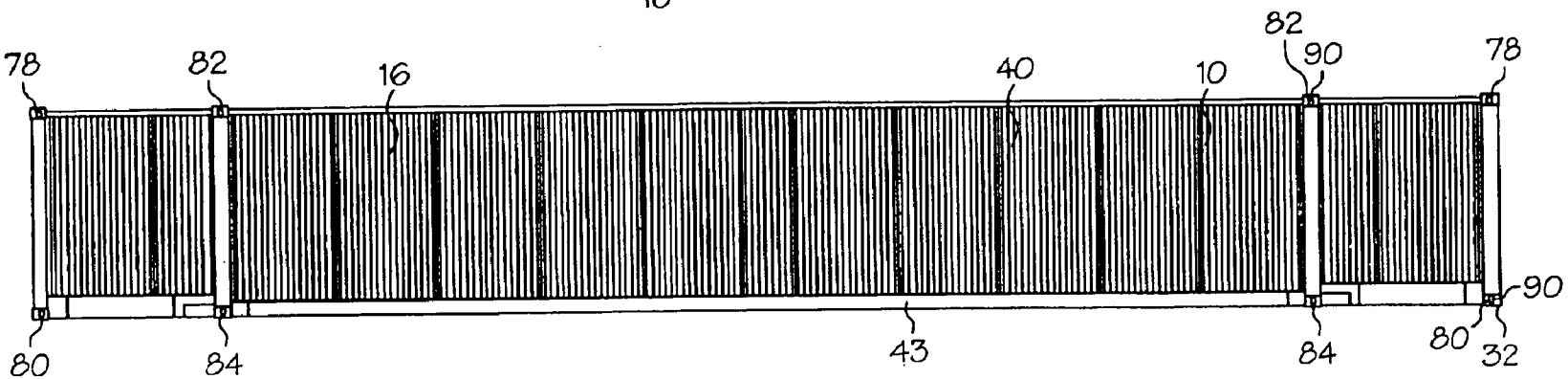
FIG. 6 is a right side view of the module of FIG. 1.

A bottom support structure, generally designated 18, extends between the side walls 14, 16 and supports the vehicles 12 that are received in the module 10. As best shown in FIG. 4, the bottom support structure 18 includes a pair of longitudinally extending wheel pans 20, 22 for receiving the wheels of a vehicle 12. A walkway 24 extends parallel to the wheel pans 20, 22, and is located adjacent the driver-side side wall 14 to provide a surface for a worker to walk upon when the module 10 is empty. A plurality of laterally extending crossbeams 26 support the wheel pans 20, 22 and the walkway 24.

The module 10 includes an angled ramp or inclined surface 30 that extends from the bottom 32 of the module 10 to the bottom support structure 18 such that vehicles 12 can be driven up the ramp 30 and into the wheel pans 20, 22 of the bottom support structure 18. The ramp 30 preferably extends from the driver-side side wall 14 to the passenger-side side wall 16. The ramp 30 is preferably integral with the module 10 and is completely internal to the module 10; that is, the ramp 30 does not extend in the longitudinal direction beyond the side walls 14, 16. Because the ramp 30 does not extend beyond the side walls 14, 16, space in the module 10 in the longitudinal direction is conserved. The lip 36 at the bottom of the ramp 30 (FIG. 1) is relatively small (i.e. preferably about 1½" high) so that a vehicle 12 can be easily driven over the lip 36. The module 10 also includes an end wall 38 that encloses the forward end of the module 10.

The module 10 includes an enclosure 40 having a generally rectangular cross section and a central space 42 for receiving the vehicles 12. A roof 44 extends between the side walls 14, 16 and parallel to the bottom support structure 18. The roof 44 and bottom support structure 18 are spaced apart a distance to closely receive a vehicle 12 therebetween to minimize the wasted vertical space in the module 10. Similarly, the side walls 14, 16 are spaced apart a distance to minimize the wasted space in a lateral direction, while still providing sufficient space between the side walls 14, 16 to accommodate the walkway 24. The wheel pans 20, 22 are offset from a longitudinally extending center line A of the module 10 (FIG. 4) toward the passenger-side side wall 16. This offset helps to minimizes the wasted space in the lateral direction by ensuring that the passenger side of the loaded vehicles 12 are located as close as practicable to the passenger-side side wall 22. As shown in FIG. 4, the driver-side wheel pan 20 is relatively narrow compared to the passenger-side wheel pan 22. The relatively narrow width of the driver-side wheel pan 20 serves to locate the vehicle 12 in the desired lateral position within the module 10, and the extra width of the passenger-side wheel pan 22 accommodates vehicles 12 of varying widths. In this manner, the driver guides the driver-side wheel of each vehicle 12 into the driver-side wheel pan 20, and does not have to worry about the location of the passenger-side wheels 22. Finally, the module 10 has a length that is selected to closely receive a predetermined number of vehicles 12 to minimize wasted space in the longitudinal direction. In the illustrated embodiment, the module 10 is sized to receive three vehicles 12.

The height of the module 10 is selected such that the vertically unutilized space is minimized. Preferably, the distance between the roof of a vehicle received in the module and the roof 44 of the module is less than 1 foot. This distance has been found to provide adequate clearance such that the vehicles do not contact the roof 44 when the vehicles are driven into the module 10, or when bumps or jolts are applied to the module 10 during transportation of the module. The 1 foot distance is also small enough to minimize wasted space in the vertical direction. If the height of the module is less than 8 feet, the desired clearance can be provided for most vehicles. Further alternately, the space between the roof of the vehicle and the roof of the module is less than about ⅓ of the height of the vehicle. Further alternately, the distance between the roof of the vehicle and the roof 44 of the module is less than about ⅕ of the height of the module.

The sides walls 14, 16, end wall 38 and roof 44 are preferably all made from corrugated metal or other materials suitable to provide the necessary structural strength and protection. The module 10 includes a skeletal framework 43 of square tubular sections at the top of the module 10 and formed channels at the bottom of the module. The driver-side side wall 14 preferably includes a plurality of openings that correspond to the driver-side door of each vehicle received in the module 10. Thus, in the illustrated embodiment, the driver-side side wall 14 includes three openings 60, 62, 64. In the illustrated embodiment, the driver-side side wall 14 includes a plurality of corrugated side panels 50 that extend approximately half the distance from the roof 44 to the bottom support structure 18. The bottom openings 52 underneath the side panels enable workers to place and remove wheel chocks (not shown) in the wheel pans 20, 22 to secure the vehicles 12 in place from outside the module 10. The driver-side side wall 14 includes a forward truss 54 and a rearward truss 56 to provide support. However, the panels 50 may alternately extend the full distance from the roof 44 to the bottom support structure 18, in which case the wheel chocks can be located by a worker who is inside the module 10.

As noted earlier, the module 10 is preferably sized to closely receive a plurality of vehicles therein. In one embodiment, the module 10 is sized to receive three vehicles and is about 53' long. In this embodiment, each of the side openings 60, 62, 64 is approximately 5' in width and approximately 6'4" in height. The opening 60 is spaced approximately 9'10" on center from the end wall 38 of the module 10, the opening 62 is located approximately at the center of the module 10 along its length, and the opening 64 is spaced about 9'10" from the rear end of the module 10. Preferably, the module 10 is one of two different heights: 6' high for vehicles 59" and below in height and 7' 6" for vehicles from 59" to 78.5" in height. The module 10 is preferably about 8' to about 8' 6" in width (i.e. the external dimension of the module 10 in the lateral direction).

Figure 3:
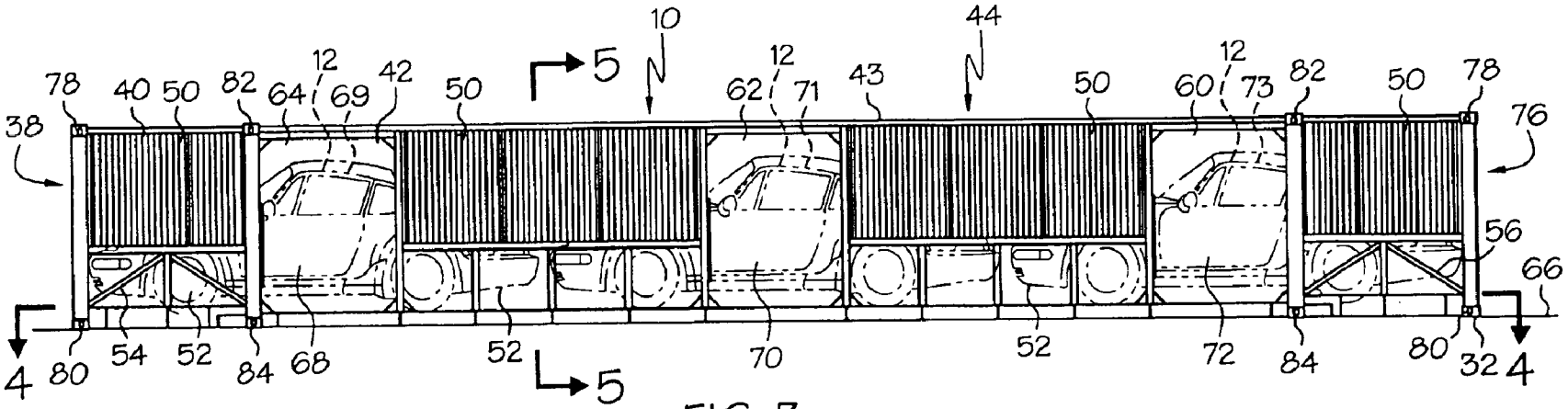
FIG. 3 is a left side view of the module of FIG. 1, shown with three vehicles loaded therein.

The module 10 of the present invention is preferably loaded with vehicles 12 as follows. The module 10 is placed flat onto an external surface 66 (FIG. 3), such as a loading dock, driveway, or the like. When placed on the external surface 66, the angled ramp 30 extends from the external surface 66 to the bottom support surface 18 of the module 10 such that vehicles 12 can be driven up the ramp 30 and into the wheel pans 20, 22 of the bottom support structure 18. Because the vehicles 12 may be driven into the module, the vehicles can be quickly and easily loaded into the module 10 without the aid of an external ramp. A first vehicle 69 is driven up the ramp 30 and onto the wheel pans 20, 22, and the first vehicle 69 is then driven through the length of the module 10 until the front driver-side door 68 of the first vehicle 69 coincides with the opening 64. The driver then opens the door 68 into the opening 64, exits the first vehicle 69, and closes the door 68. The driver then may exit the module through the opening 64. Thus, besides providing a space through which the front driver-side door 68 is received, the opening 64 provides an exit path from the module 10 for the driver. When the driver exits through the opening 64, this helps to minimize any further damage that may be imparted to the vehicle when the driver walks alongside the first vehicle 69. For example, keys, tools, or other items that the driver may carry, or a belt buckle or other metallic clothing items on the driver may damage the vehicle as the driver walks alongside the first vehicle 69. Thus, by minimizing the distance the driver must walk alongside the vehicles 12, the chances of damaging the vehicles 12 in such a manner are correspondingly minimized. When unloading the vehicles 12, the openings 60, 62, 64 also provide a point of entry into the module 10 to minimize driver-induced damage.

The driver or another worker then places wheel chocks (not shown) in front of the front driver-side wheel, and behind the rear driver-side wheel of the first vehicle 69 to secure the first vehicle 69 in the module 10. The wheel chocks or other securements can be placed in position by reaching through the bottom openings 52. This enables a worker to place the wheel chocks from outside the module 10, which minimizes contact with the vehicles 12. After the first vehicle 69 is secured in the module 10, a second vehicle 71 is driven into the module 10 in a similar manner such that the front driver-side door 70 of the second vehicle 71 coincides with the opening 62. The driver then exits through the opening 62 and secures the second vehicle 71 with wheel chocks. Finally, a third vehicle 73 may be driven into the module 10 such that the driver-side door 72 of the third vehicle 73 coincides with the opening 60. The driver then preferably exits through the opening 60 and secures the third vehicle 73 in place.

Once the module 10 is fully loaded, a tarp 74 (FIG. 1) may be located over the rear end opening 76 of the module 10 to protect the vehicles 12. The module 10 may then be loaded onto a barge, chassis, rail car, or other transportation system. The module 10 is stackable so that a number of modules can be stacked both side-by-side and/or on top of one another (i.e. up to five or six modules high). Accordingly, each module 10 preferably includes a set of upper corner castings 78 and a set of lower corner castings 80 for receiving twist locks (not shown) therein. The twist locks help to secure the vertically-stacked modules to each other at their corner castings. The lower corner castings 80 may also be used to secure the front end of the module 10 to a chassis by receiving lock pins therein.

The module 10 further preferably includes a set of intermediate upper castings 82 and intermediate lower castings 84. The intermediate upper castings 82 are preferably longitudinally spaced about 40' apart such that the module 10 can be lifted by a standard ISO ("International Standards Organization") spreader that fits into the intermediate upper castings 82. The intermediate upper castings 82 can also be used to lock the module 10 (through the use of twists locks) to a standard container that is stacked on top of the module 10. The intermediate lower castings 84 are also preferably spaced apart about 40', and can be used to lock the module 10 onto a standard 40' long container when the module 10 is stacked onto a standard container (not shown). This feature is particularly useful when stacking the module 10 onto a standard container in a double stack rail car. The standard container may be located in the well of the rail car, and the module 10 stacked on top of the standard container and secured to the standard container by twist locks passed through the lower intermediate castings 84 and the corner castings of the standard container.

Each of the castings 78, 80, 82, 84 preferably includes side apertures 90 such that lashings can be passed through the side apertures 90 to secure the module 10. The side apertures 90 also provide a surface for receiving the hook of a loading machine to load or move the module 10. One embodiment of the twist locks that can be used with the corner castings 78, 80, 82, 84 are model C5AM-DF double cone semi-automatic twist locks manufactured by Buffers USA of Jacksonville, Fla. One embodiment of the corner casting 78, 80, 82, 84 may also be obtained from Buffers USA and are ISO type corner castings that are modified for the extra width of the module 10.

Figure 2:
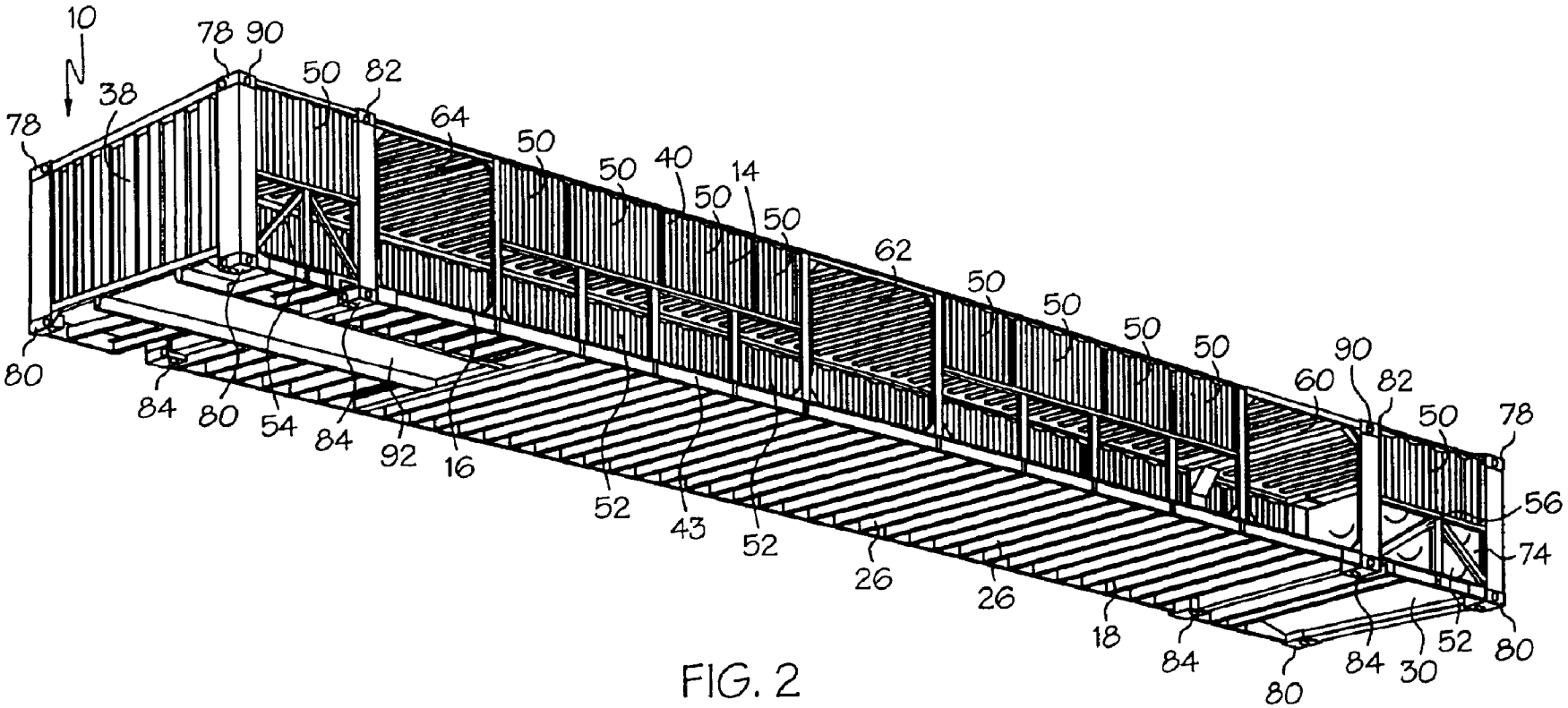
FIG. 2 is a bottom perspective view of the module of FIG. 1.

The module 10 includes a standard-sized cutout, or tunnel 92, in its bottom support structure 18, as best shown in FIG. 2. When the module 10 is loaded onto a chassis, the tunnel 92 is shaped to receive the gooseneck of the chassis to help lock the module 10 into position on the chassis.

When stacking two or more modules side-by-side, the outermost modules are preferably arranged such that the passenger-side side wall 16 of each module faces outward and the openings 60, 62, 64 of each module face inwardly. Because the passenger-side side wall 16 lacks the openings 60, 62, 64, it provides greater protection from the elements, such as sea spray or rain. For example, if two modules are to be stacked side-by-side, they are preferably arranged such that the openings 60, 62, 64 face each other and the passenger-side side walls 16 are located around the outer perimeter of the two modules. If multiple modules are stacked side-by-side, they are preferably arranged such that the driver-side side walls 14 of the end modules face inwardly. Alternately, a standard container may be located adjacent the driver-side side wall 16 of a module to cover the opening 60, 62, 64 and protect the vehicles in the module 10. Further alternately, a tarp may be used to cover the opening 60, 62, 64.

While the method and apparatus disclosed herein constitute preferred embodiments of the invention, the invention is not limited to these precise methods and apparatuses, and other methods and apparatuses may be used without departing from the scope of the invention.

What is claimed is:

1. A method for loading vehicles for transportation comprising the steps of:

providing a module including a driver-side side structure, a passenger-side side structure, a bottom support structure extending between said side structures for supporting at least one vehicle located thereon, and a roof structure spaced from said bottom support structure such that said roof structure and said bottom support structure are arranged to closely receive a single row of vehicles therebetween and wherein said module includes a ramp located generally entirely inside said module; and rolling said vehicles onto said bottom support structure such that a single row of vehicles is located in said module and no vehicles are located generally between said single row of vehicles and said roof structure and no vehicles are located generally between said single row of vehicles and said bottom support structure and wherein said rolling step includes rolling each vehicle over said ramp such that said ramp guides each vehicle from an external surface to said bottom support structure without the need for an additional ramp.

2. The method of claim 1 further comprising the step of stacking said module which contains said vehicles on top of another module.

3. The method of claim 2 wherein said another module is located on a carrier such that said stacking step includes stacking said module which contains said vehicles on a carrier.

4. The method of claim 3 wherein said carrier is a vessel.

5. The method of claim 3 wherein said carrier is a truck chassis.

6. The method of claim 3 wherein said carrier is a train car.

7. The method of claim 1 wherein each side structure is a generally continuous wall to protect any vehicles received in said module.

8. The method of claim 7 wherein said driver-side side structure includes at least one opening that is located to receive a driver's door of a vehicle therethrough.

9. The method of claim 8 further including the step of opening said vehicle door through said opening to enable a driver of said vehicle with said door to exit said vehicle with said door after said rolling step.

10. The method of claim 7 wherein said driver-side side structure includes a plurality of openings that are located to correspond to the front driver-side door any vehicle received in said module.

11. The method of claim 1 wherein said roof structure is a generally continuous horizontally-extending structure which substantially covers each vehicle located in said module.

12. The method of claim 1 wherein said bottom support structure and said roof structure have complementary shapes such that said module can be stacked on another module.

13. The method of claim 12 wherein said bottom support structure and said roof structure are both generally flat.

14. The method of claim 1 wherein the distance between each vehicle and said roof structure is less than about 1 foot.

15. The method of claim 1 wherein the distance between each vehicle and said roof structure is less than about ⅓ of the height of said module.

16. The method of claim 1 wherein the distance between each vehicle and said roof structure is less than about ⅕ of the height of said module.

17. The method of claim 1 further comprising the step of securing each vehicle in said module after said rolling step.

18. The method of claim 1 further comprising the step of locating said module on an external surface before said rolling step such that said bottom support structure is located directly on said external surface.

19. The method of claim 18 wherein said rolling step includes driving each vehicle from said external surface onto said bottom support structure.

20. A method for loading vehicles for transportation comprising the steps of:

providing a module including a driver-side side structure, a passenger-side side structure, a bottom support structure extending between said side structures for supporting at least one vehicle located thereon, and a roof structure spaced from said bottom support structure such that said roof structure and said bottom support structure are arranged to closely receive a single row of vehicles therebetween, wherein each side structure is a generally continuous wall to protect any vehicles received in said module and wherein said driver-side side structure includes at least one opening that is located to receive a driver's door of a vehicle therethrough; and rolling said vehicles onto said bottom support structure such that a single row of vehicles is located in said module and no vehicles are located generally between said single row of vehicles and said roof structure and no vehicles are located generally between said single row of vehicles and said bottom support structure.

21. A method for loading vehicles for transportation comprising the steps of:

providing a module including a driver-side side structure and a passenger-side side structure, each side structure being a generally continuous wall to protect any vehicles received in said module, said module further including a bottom support structure extending between said side structures for supporting at least one vehicle located thereon, said module further including a roof structure spaced from said bottom support structure such that said roof structure and said bottom support structure are arranged to closely receive a single row of vehicles therebetween; and rolling said vehicles onto said bottom support structure such that a single row of vehicles is located in said module and no vehicles are located generally between said single row of vehicles and said roof structure and no vehicles are located generally between said single row of vehicles and said bottom support structure and wherein the distance between each vehicle and said roof structure is less than about ⅓ of the height of said module.

* * * * *

UNITED STATES PATENT AND TRADEMARK OFFICE

CERTIFICATE OF CORRECTION

PATENT NO. : 6,890,136 B2
DATED : May 10, 2005
INVENTOR(S) : Ralph W. Heim et al.

It is certified that error appears in the above-identified patent and that said Letters Patent is hereby corrected as shown below:

Title page,
Item [75], Inventors, change "Prakas" to -- Prakash --.

Signed and Sealed this

Twelfth Day of July, 2005

JON W. DUDAS
*Director of the United States Patent and Trademark Office*